US005679492A

United States Patent [19]

Chamberlain et al.

[11] Patent Number: 5,679,492

[45] Date of Patent: Oct. 21, 1997

[54] DEVELOPER COMPOSITIONS

[75] Inventors: Scott D. Chamberlain, Macedon; Edward B. Caruthers, Jr., Rochester; Constance J. Thornton, Ontario; George A. Gibson, Fairport, all of N.Y.

[73] Assignee: Xerox Corporation, Stamford, Conn.

[21] Appl. No.: 694,358

[22] Filed: Aug. 8, 1996

[51] Int. Cl.[6] ..... G03G 9/13

[52] U.S. Cl. ..... 430/115; 430/117

[58] Field of Search ..... 430/114, 115, 430/117

[56] References Cited

U.S. PATENT DOCUMENTS

| | | | |
|---|---|---|---|
| H1483 | 9/1995 | Larson et al. | 430/115 |
| 5,019,477 | 5/1991 | Felder | 430/115 |
| 5,030,535 | 7/1991 | Drappel et al. | 430/116 |
| 5,223,368 | 6/1993 | Ciccarelli et al. | 430/110 |
| 5,306,591 | 4/1994 | Larson et al. | 430/115 |
| 5,308,731 | 5/1994 | Larson et al. | 430/115 |
| 5,451,483 | 9/1995 | Fuller et al. | 430/115 |

*Primary Examiner*—John Goodrow
*Attorney, Agent, or Firm*—E. O. Palazzo

[57] ABSTRACT

A negatively charged liquid developer comprised of a non-polar liquid, a mixture of a first and a second thermoplastic resin with dissimilar melt indexes, a pigment, charge director, optional charge adjuvent, a charge control agent comprised of a component of the alternative formulas

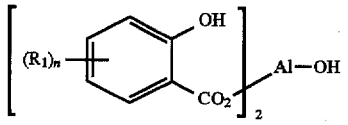

or

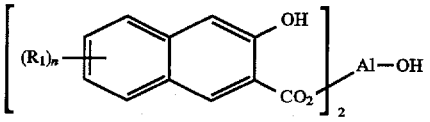

wherein $R_1$ is selected from the group consisting of hydrogen and alkyl, and n is 0 (zero), 1, 2, 3, or 4, and wherein the melt index of the first resin is from about 50 to about 800 grams, and the melt index of the second resin from about 850 to about 2,500 grams.

27 Claims, No Drawings

DEVELOPER COMPOSITIONS

BACKGROUND OF THE INVENTION

This invention is generally directed to developer compositions and, more specifically, the present invention relates to a negatively charged liquid developer containing a mixture of resins, preferably two resins, one resin with acid residues, such as NUCREL®, that is covalently bonded to the developer charge control agent, and the second which is comprised of a polyethylene vinyl acetate, and which second resin functions primarily to reduce the developer fixing temperature. More specifically, the present invention relates to liquid developers comprised of a mixture of resins, especially two resins with different, or dissimilar melt indexes (MI), a nonpolar liquid, a pigment, or dye, a charge director, and charge control agents or additives such as those of the alternative formulas

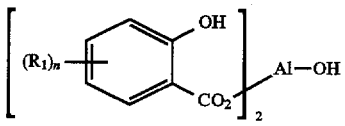

or

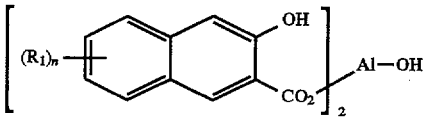

wherein $R_1$ is selected from the group consisting of hydrogen and alkyl, and n represents a number and can be 0 (zero), 1, 2, 3, or 4. A preferred charge additive is aluminum-di-tertiary-butyl salicylate. The developers of the present invention can be selected for a number of known imaging systems, such as xerographic imaging and printing processes, wherein latent images are rendered visible with the liquid developers illustrated herein. Image quality, solid area coverage and resolution characteristics for developed images usually require, for example, sufficient toner particle electrophoretic mobility. The mobility required for effective image development is primarily dependent on the imaging system used. The electrophoretic mobility is directly proportional to the charge on the toner particles and inversely proportional to the viscosity of the liquid developer fluid. For example, a 10 to 30 percent increase in fluid viscosity caused, for instance, by a 5° to 15° C. decrease in temperature could result in a decrease in image quality, poor or unacceptable image development and undesirable background development, for example, because of a decrease in electrophoretic mobility. Insufficient particle charge can also result in poor transfer of the toner to paper or other final substrates. Poor transfer can, for example, result in poor solid area coverage if insufficient toner is transferred to the final substrate and can also cause image defects such as smears and hollowed fine features. To overcome or minimize such problems, the liquid toners of the present invention were arrived at after extensive research, and which toners result in, for example, sufficient particle charge to transfer and maintain their mobility within the required range of the particular imaging system employed. Other advantages associated with the present invention include increasing the desired negative charge on the developer particles and providing a charge adjuvant, or a charge control agent, that is superior to other known charge control agents like aluminum stearate. The aforementioned desired charge can result in improved image development and enhanced transfer.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid, which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

Since the formation of proper images depends primarily on the difference in the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising thermoplastic resin, nonpolar liquid and colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors such as lecithin, oil-soluble petroleum sulfonates and alkyl succinimide, and positive charge directors such as cobalt and iron naphthanates.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge control agent. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

In U.S. Pat. No. 5,223,368, the disclosure of which is totally incorporated herein by reference, there is illustrated a dry toner with the charge additive aluminum-di-tertiary-butyl salicylate.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., wherein contacting occurs while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

Illustrated in U.S. Pat. No. 5,306,591 is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 is a liquid developer comprised of thermoplastic resin particles, and a charge director comprised of an ammonium AB diblock copolymer of the formula recited wherein X- is a conjugate base or anion of a strong acid, R is hydrogen or alkyl, R' is alkyl, R" is an alkyl group containing from about 6 to about 20 carbon atoms, and y and x represent the number average degree of polymerization (DP) wherein the ratio of y to x is in the range of from about 10 to 2; and in U.S. Pat. No. 5,308,731 is a liquid developer comprised of a liquid, thermoplastic resin particles, a nonpolar liquid soluble charge director, and a charge adjuvant comprised of a metal hydroxycarboxylic acid. The disclosures of each of these patents are totally incorporated herein by reference.

SUMMARY OF THE INVENTION

It is an object of the present invention to provide a liquid developer with many of the advantages illustrated herein.

Another object of the present invention resides in the provision of a liquid developer capable of high particle charging, and wherein improved image fusing is obtained, and wherein excellent development to and transfer from imaging members, such as known photoconductive imaging members, can be obtained.

It is a further object of the invention to provide a liquid developer wherein there are selected as charge control agents certain metal salicylates to enhance the negative charge of the developer, and provide differently colored toners with similar charging characteristics; and wherein a lower melt index resin permits fusing at lower temperatures, and a higher melt index resin enables fusing at a higher temperature providing glossy and matte developed images.

It is still a further object of the invention to provide a liquid developer wherein developed image defects, such as smearing, loss of resolution and loss of density, are eliminated or minimized.

Also, in another object of the present invention there are provided negatively charged liquid developers with certain charge control agents that are in embodiments superior to, for example, aluminum stearate in that they result in higher negative toner particle charge. The superior charge can result in improved image development and transfer.

Furthermore, in another object of the present invention there are provided liquid toners that enable excellent image characteristics, and which toners enhance the negative charge of resin, such as NUCREL®, based colored toners.

These and other objects of the present invention can be accomplished in embodiments by the provision of liquid developers with certain resins, and wherein a combination of certain components enables many of the improvements and advantages illustrated herein. In embodiments, the present invention is directed to liquid developers comprised of a nonpolar liquid, pigment, a mixture of two resins, charge director, aluminum hydroxide charge control agents, such as the aluminum salts of alkylated salicylic acid, like, for example, hydroxy bis[3,5-tertiary butyl salicylic] aluminate, and which charge additive can be represented by the following formulas, or the hydrates thereof

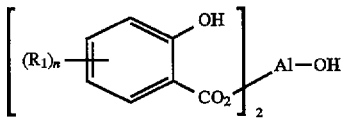

or

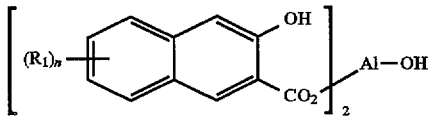

wherein $R_1$ is selected from the group consisting of hydrogen and alkyl, and n is a number such as 0 (zero), 1,2, 3, or 4.

Of importance with respect to the present invention is the selection of two dissimilar resins with different melt indexes, and more specifically, the present invention in embodiments is directed to a negatively charged liquid developer comprised of a nonpolar liquid, a mixture of two thermoplastic resins with dissimilar melt indexes, a pigment, charge director, optional charge adjuvent, a charge control agent comprised of a component of the alternative formulas

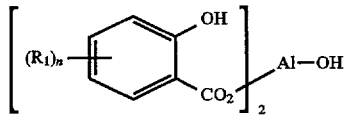

or

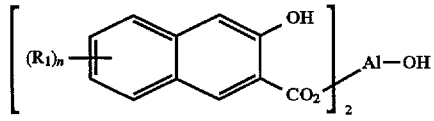

wherein $R_1$ is selected from the group consisting of hydrogen and alkyl with, for example, to about 25 carbon atoms, and n is 0 (zero), 1, 2, 3, or 4, and wherein the melt index of the first resin is from about 50 to about 800 and the melt index of the second resin is from about 850 to about 2,500; a process for the preparation of a liquid developer with improved fixing characteristics which comprises mixing a nonpolar liquid, a mixture of two thermoplastic resins wherein one resin has a melt index of from about 50 to about 800, and the second resin has a melt index of from about 850 to about 2,500, pigments, charge director and charge control agent; heating the mixture; and subsequently cooling the mixture; and also wherein the two resins selected possess dissimilar melt index of from, for example, a melt index of from about 50 to about 800 grams for one resin, and from about 850 to about 2,500 grams for the second resin.

Typical suitable thermoplastic toner resins that can be selected for the liquid developers of the present invention in effective amounts, for example, in the range of about 99 percent to about 40 percent, and preferably 95 percent to 70 percent of developer solids comprised of thermoplastic resin, pigment, charge aluminum additive, and in embodiments other components that may comprise the toner. Generally, developer solids include the thermoplastic resin, optional pigment and charge control agent. Examples of resins include ethylene vinyl acetate (EVA) copolymers (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers in embodiments include the copolymers of ethylene and an α-β-ethylenically unsaturated acid of either acrylic acid or methacrylic acid. In preferred embodiments, NUCREL® resins available from E.I. DuPont de Nemours and Company like NUCREL® 599, NUCREL® 699, or NUCREL® 960 are selected as the thermoplastic resin.

Examples of preferred resins selected include a mixture of two resins, a first and second resin as follows:

First Resin

DuPont resins containing methacrylic acid;

DuPont NUCREL 599®, 400 Melt Index, 10 weight percent to about 90 percent component with 50 weight percent being preferred;

DuPont NUCREL RX-76®, 800 Melt Index, 10 weight percent to about 90 weight percent component with 50 weight percent being preferred.

Second Resin

DuPont resins containing vinyl acetate (28 weight percent vinyl acetate);

DuPont ELVAX 205W®, 850 Melt Index, 90 weight percent to about 10 weight percent with 50 percent being preferred;

DuPont ELVAX 200W®, 2500 Melt Index, 90 weight percent to about 10 weight percent with 50 percent being preferred.

| RESIN | MELT INDEX (APPROX.) | FIX TIME |
|---|---|---|
| 100 percent NUCREL 599 ® | 400 | >30 minutes |
| 50 percent NUCREL RX-76 ®<br>50 percent ELVAX 205W ® | 825 | <4 minutes |

-continued

| RESIN | MELT INDEX (APPROX.) | FIX TIME |
|---|---|---|
| 50 percent NUCREL RX-76 ®<br>50 percent ELVAX 200W ® | 1650 | <2.5 minutes |

The fix time refers to the amount of time needed for the toner to fix to paper such as Xerox Corporation 4024.

One advantage of mixing resins, especially the above resins for liquid developer, is that a mixture can be selected to enable a specific desirable fixing characterization based on the melt indices of the resin components.

Examples of specific charge additives selected for the toners of the present invention, and present in various effective amounts of, for example, from about 0.1 to about 15, and preferably from about 1 to about 4 weight percent, include aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; bis[tetraalkylated hydroxy naphthoic acid] aluminate wherein alkyl preferably contains 1 to about 6 carbon atoms; and the like, The aforementioned additives can be prepared as illustrated in U.S. Pat. No. 5,223,368, the disclosure of which is totally incorporated herein by reference, and more specifically, these additives can be obtained by the reaction of two equivalents of the sodium salt of, for example, 3,5-di-tert-butyl salicylic acid with one half equivalent of a dialuminum salt, for example aluminum sulfate, $Al_2(SO_4)_3$, in an aqueous alkali solution which generates a 2:1 complex of two salicylic acid molecules about a single central aluminum atom wherein both carboxylate groups of the salicylic acid moieties are covalently bonded through the carboxylate oxygen atom to the aluminum atom.

Examples of liquid carriers or components selected for the developers of the present invention include a liquid with an effective viscosity of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40°

C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3.0 in embodiments of the present invention. Moreover, the vapor pressure at 25° C. should be less than 10 Torr in embodiments.

While the ISOPAR® series liquids can be the preferred nonpolar liquids for use as dispersants in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 85 to about 99.9 weight percent, and preferably from about 90 to about 99 percent by weight of the total developer dispersion, however, other effective amounts may be selected. The total solids content of the developer in embodiments is, for example, 0.1 to 15 percent by weight, preferably 0.3 to 10 percent. Solids weight or content refers to the fraction of toner remaining after the solvent or nonpolar liquid has been evaporated, e.g. by heating in an oven for 4 hours.

The liquid developer of the present invention may optionally contain, and preferably does contain in embodiments a colorant dispersed in the resin particles. Colorants, such as pigments or dyes and mixtures thereof, are preferably present to render the latent image visible.

The colorant may be present in the toner in an effective amount of, for example, from about 0.1 to about 60 percent, and preferably from about 1 to about 40, and in embodiments 10 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, those pigments as illustrated in U.S. Pat. No. 5,223,368, the disclosure of which is totally incorporated herein by reference; other known pigments; and the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

Suitable nonpolar liquid soluble ionic or zwitterionic charge director compounds include anionic glyceride, such as EMPHOS D70-30C™ and EMPHOS F27-85™, two products available from Witco Corporation, New York, N.Y., which are sodium salts of phosphated mono and diglycerides with unsaturated and saturated acid substituents, respectively, reference copending application U.S. Ser. No. 08,505,043, the disclosure of which is totally incorporated herein by reference, lecithin, BASIC BARIUM PETRONATE®, NEUTRAL BARIUM PETRONATE®, CALCIUM PETRONATE®, NEUTRAL CALCIUM PETRONATE®, oil soluble petroleum sulfonates, Witco Corporation, New York, N.Y.; metallic soaps such as barium, calcium, lead, and zinc stearates; cobalt, manganese, lead, and zinc linoleates, calcium and cobalt octoates, quaternary ammonium block copolymers as illustrated, for example, in U.S. Pat. No. 5,035,972, the disclosure of which is totally incorporated herein by reference, other known charge directors, and the like which are selected in various effective amounts, such as for example from about 0.25 to about 1,500 milligrams/gram (per gram of developer solids), and preferably 2.5 to 400 milligrams/gram based on the amount of developer solids comprised of resin, pigment, and charge control agent or additive.

The charge on the toner particles may be measured with respect to particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustic effect, the application of an electric field, and the measurement of sound described, for example, in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high measured mobilities have been shown to result in improved image density, higher image resolution and superior transfer efficiency. Residual conductivity, that is the conductivity from the charge director, can be measured with a low field device as described herein.

To increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particles, while the positive charge adjuvants increase the positive charge of the toner particles. With the invention of the present application, these types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0. 1 percent to about 15 percent of the total developer solids and preferably from about 1 percent to about 5 percent of the total weight of solids contained in the developer.

The liquid electrostatic developer of the present invention can be prepared by a variety of processes such as, for example, mixing in a nonpolar liquid the thermoplastic resin mixture, charging additive, and optional colorant and adjuvant in a manner that the resulting mixture contains, for example, about 15 to about 40 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 30° C.; adding charge director compound to the dispersion; and diluting the dispersion.

In the initial mixture, the resin mixture, colorant and charge additive may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like spheres or cylinders of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, charge director, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 20 percent by weight.

The dispersion is then cooled to about 10° C. to about 40° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene gylcol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference. The charge director can be added during or after the above preparative sequence.

As illustrated herein, the developers or inks of the present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

Embodiments of the invention will be illustrated in the following nonlimiting Examples, it being understood that these Examples are intended to be illustrative only and that the invention is not intended to be limited to the materials, conditions, process parameters and the like recited. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of −26 millivolts for a 10 percent (v/v) suspension of LUDOX™ (DuPont). The system was then set up for nonaqueous measurements. The toner particle mobility can be dependent on a number of factors, including primarily particle charge and particle size. The ESA system also calculates the zeta potential which is directly proportional to toner charge and is independent of particle size. Particle size was measured by Horiba CAPA-500 centrifugal automatic particle analyzer manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

50 Percent ELVAX 205W® and 50 Percent NUCREL RX-76®; 0.5 Percent Alohas

Eighty-four (84) grams of NUCREL RX-76®, poly (ethylene-co-methacrylic acid, (a copolymer of ethylene and methacrylic acid with a melt index at 190° C. of 800 grams, available from E.I. DuPont de Nemours & Company, Wilmington, Del.), 1.14 grams of the charge control agent Alohas (aluminum di-t-butyl salicylate), 56.8 grams of the yellow pigment (Paliotol Yellow D1155®) and 370 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 75° to 95° C. for 1 hour. After the 1 hour of hot milling in the attritor, to the mixture wwere s added 84.0 grams of ELVAX 205W®, poly(ethylene-co-vinylacetate), (a copolymer of ethylene and vinyl acetate with a melt index at 190° C. of 850, available from E.I. DuPont de Nemours & Company, Wilmington, Del.), and the mixture was milled in the attritor which was heated with running steam through the attritor jacket at 60° to 80° C. for 1 hour. To the mixture were added 980 grams of ISOPAR-G® (Exxon Corporation), then cooled by running water through the attritor jacket to 23° C., and ground in the attritor for an additional 2 hours. Additional ISOPAR-G® was added and the mixture was separated by the use of a metal grate from the steel balls. To 108.9 grams of the mixture (13.77 percent solids) were added 1,376.1 grams of ISOPAR-G® and 1.5 grams of 93,000 $M_w$, the known charge director AB polymer 2.5:97.5 HBr quaternary salt, poly[2-ethylhexyl methacrylate (B block) co-dimethyl-ammoniumethyl methacrylate bromide (A block)]. The image quality and fix time were assessed using a Savin 870 copier. The image quality is excellent with minimum background deposits, and the images possessed excellent to optimum fushing characteristics.

EXAMPLE II

50 Percent ELVAX 200W® and 50 Percent NUCREL RX-76®; 0.5 Percent ALOHAS

Eighty-four (84) grams of NUCREL RX-76® (a copolymer of ethylene and methacrylic acid with a melt index at 190° C. of 800, available from E.I. DuPont de Nemours & Company, Wilmington, Del.), 1.14 grams of the charge control agent Alohas (aluminum di-t-butyl salicylate), 56.8 grams of the yellow pigment (Paliotol Yellow D1155™), and 370 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 75° to 95° C. for 1 hour. After the 1 hour of hot milling in the attritor, to the mixture were added 84.0 grams of ELVAX 200W® (a copolymer of ethylene and vinyl acetate with a melt index at 190° C. of 2500, available from E.I. DuPont de Nemours & Company, Wilmington, Del.), and the mixture was milled in the attritor which was heated with running steam through the attritor jacket at 60° to 80° C. for 1 hour. To the mixture were added 980 grams of ISOPAR-G® (Exxon Corporation), then cooled by running water through the attritor jacket to 23° C., and ground in the attritor for an additional 2 hours. Additional ISOPAR-G® was added and the mixture was separated by the use of a metal grate from the steel balls. To 114.0 grams of the mixture (13.16 percent solids) were added 1,356 grams of ISOPAR-G® and 1.5 grams of 93,000 $M_w$, known AB 2.5:97.5 HBr quaternary salt charge director. Similar imaging results to that of Example I are believed to be achievable.

CONTROL 1

100 Percent NUCREL 599®; 0.5 Percent ALOHAS

One Hundred Sixty Eight (168) grams of NUCREL 599®(a copolymer of ethylene and methacrylic acid with a melt index at 190° C. of 400, available from E.I. DuPont de Nemours & Company, Wilmington, Del.), 1.14 grams of the charge control agent Alohas (aluminum di-t-butyl salicylate) 56.8 grams of the yellow pigment (Paliotol Yellow D1155™), and 370 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 75° to 95° C. for 2 hours, then cooled by running water through the attritor jacket to 23° C., and ground in the attritor for an additional 4 hours. Additional ISOPAR-G® was added and the mixture was separated by the use of a metal grate from the steel balls. To 110.9 grams of the mixture (13.53 percent solids) were added 1,376 grams of ISOPAR-G® and 1.5 grams of 93,000 $M_w$, AB 2.5:97.5 HBr quaternary salt charge director.

Image development resolution and fixing were of lower quality then the images of Example s I and II, where two resins with different melt indexes were selected.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A negatively charged liquid developer consisting essentially of a nonpolar liquid, a mixture of a first and a second thermoplastic resin with dissimilar melt indexes, a pigment, charge director, optional charge adjuvent, a charge control agent comprised of a component of the alternative formulas

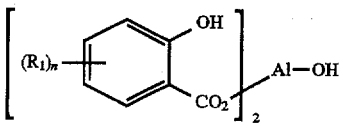

or

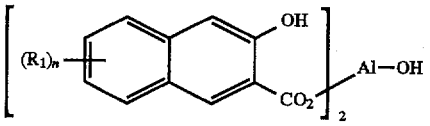

wherein $R_1$ is selected from the group consisting of hydrogen and alkyl, and n is0 (zero), 1,2, 3, or4, and wherein the melt index of the first resin is from about 50 to about 800 grams, and the melt index of the second resin from about 850 to about 2,500 grams.

2. A liquid developer in accordance with claim 1 wherein one resin is present in an amount of from about 10 to about 90 parts, and a second resin is present in an amount of from about 90 to about 10 parts.

3. A liquid developer in accordance with claim 2 wherein the first resin is a resin, a methacrylic acid, or an acrylic acid containing resin.

4. A liquid developer in accordance with claim 1 wherein the first resin is a copolymer of ethylene and methacrylic acid with a melt index of about 800 at about 190° C.

5. A liquid developer in accordance with claim 1 wherein the second resin is polyethylene vinyl acetate.

6. A liquid developer in accordance with claim 2 wherein the second resin is a copolymer of ethylene and vinyl acetate with a melt index of about 850 at about 190° C.

7. A liquid developer in accordance with claim 2 wherein the first resin is a methacrylic acid copolymer, and the second resin is polyethylene vinyl acetate.

8. A liquid developer in accordance with claim 1 wherein the first resin has a melt index of about 800, and the second resin has a melt index of about 2,500.

9. A liquid developer in accordance with claim 1 wherein the first resin is present in the resin mixture of from about 10 to about 90 parts, and the second resin is present in the resin mixture in an amount of from about 90 to about 10 parts.

10. A liquid developer in accordance with claim 1 wherein alkyl contains from 1 to about 25 carbon atoms.

11. A liquid developer in accordance with claim 1 wherein $R_1$ is hydrogen, methyl, ethyl, propyl, or butyl.

12. A liquid developer in accordance with claim 1 wherein $R_1$ is hydrogen, isopropyl, n-butyl, isobutyl, or tert-butyl.

13. A liquid developer in accordance with claim 1 wherein the charge control agent is a hydroxy aluminum complex of the formula as represented by

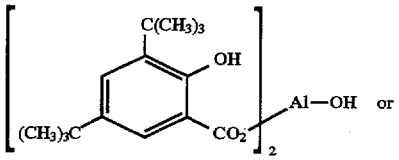

-continued

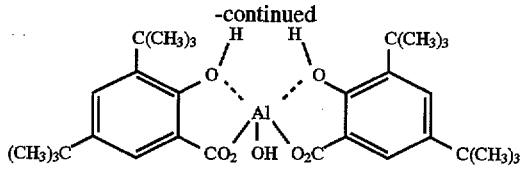

14. A liquid developer in accordance with claim 1 wherein the charge control agent is selected from the group consisting of hydroxy bis[3,5-di-tert-butyl salicylic] aluminate, hydroxy bis[3,5-di-tert-butyl salicylic] aluminate monohydrate, hydroxy bis[3,5-di-tert-butyl salicylic] aluminate dihydrate, hydroxy bis[3,5-di-tert-butyl salicylic] aluminate tri- or tetrahydrate, and mixtures thereof.

15. A liquid developer in accordance with claim 1 wherein the pigment is present in an amount of from about 5 to about 60 percent by weight based on the total weight of the developer solids of resin, pigment, and charge control agent.

16. A liquid developer in accordance with claim 2 wherein the pigment is cyan, magenta, yellow or mixtures thereof.

17. A liquid developer in accordance with claim 2 wherein the pigment is carbon black.

18. A liquid developer in accordance with claim 1 further containing a charge adjuvant selected from the group consisting of polyhydroxy compounds which contain at least 2 hydroxy groups, amino alcohols, polybutylene succinimide and metallic soaps.

19. A liquid developer in accordance with claim 1 wherein the liquid for said developer is an aliphatic hydrocarbon.

20. A liquid developer in accordance with claim 19 wherein the aliphatic hydrocarbon is a mixture of branched hydrocarbons of from about 12 to about 16 carbon atoms, or a mixture of normal hydrocarbons of from about 10 to about 16 carbon atoms.

21. An imaging method which comprises forming an electrostatic latent image followed by the development thereof with the liquid developer of claim 1.

22. An imaging method which comprises forming an electrostatic latent image followed by the development thereof with the liquid developer of claim 2.

23. A process for the preparation of a liquid developer with improved fixing characteristics which comprises mixing a nonpolar liquid, a mixture of two thermoplastic resins wherein one resin has a melt index of from about 50 to about 800, and the second resin has a melt index of from about 850 to about 2,500 pigments, charge director and charge control agent; heating the mixture; and subsequently cooling the mixture.

24. A liquid developer in accordance with claim 1 wherein the first resin poly(ethylene-co-methacrylic acid.

25. A liquid developer in accordance with claim 1 wherein the secon drein is poly(ethylene-co-vinylacetate).

26. A developer in accordance with claim 1 wherein the first resin is a copolymer of ethylene and methacrylic acid with a melt index at 190° C. of 800 grams, and the second resin is a copolymer of ethylene and vinyl acetate with a melt index at 190° C. of 850 grams.

27. A developer in accordance with claim 1 wherein the first resin is a copolymer of ethylene and methacrylic acid with a melt index at 190° C. of 800 grams, and the second resin is a copolymer of ethylene and vinyl acetate with a melt index at 190° C. of 2,500 grams.

* * * * *